US011679620B2

(12) United States Patent
Galvan

(10) Patent No.: US 11,679,620 B2
(45) Date of Patent: Jun. 20, 2023

(54) SNAPPING CHALK LINE ANGLES WITH PRECISION

(71) Applicant: Jacob Roosevelt Galvan, Corpus Christi, TX (US)

(72) Inventor: Jacob Roosevelt Galvan, Corpus Christi, TX (US)

( * ) Notice: Subject to any disclaimer, the term of this patent is extended or adjusted under 35 U.S.C. 154(b) by 0 days.

(21) Appl. No.: 17/410,607

(22) Filed: Aug. 24, 2021

(65) Prior Publication Data

US 2023/0060197 A1 Mar. 2, 2023

(51) Int. Cl.
*B44D 3/38* (2006.01)

(52) U.S. Cl.
CPC ..... *B44D 3/38* (2013.01)

(58) Field of Classification Search
CPC ..... B44D 3/38
See application file for complete search history.

(56) References Cited

U.S. PATENT DOCUMENTS

| | | | | |
|---|---|---|---|---|
| 4,995,152 | A * | 2/1991 | Steckler | B44D 3/38 33/409 |
| 5,937,532 | A | 8/1999 | Eirich | |
| 6,082,014 | A | 7/2000 | Beyers | |
| 6,931,743 | B1 | 8/2005 | Scarborough | |
| 7,506,454 | B1 * | 3/2009 | Balliet | B44D 3/225 33/414 |
| 8,567,079 | B2 * | 10/2013 | Cerwin | B43L 13/002 33/1 G |
| 9,701,155 | B2 | 7/2017 | Henderson | |
| 9,802,441 | B2 | 10/2017 | Douglas | |
| 10,071,594 | B2 | 9/2018 | Chernyshou | |
| 10,442,240 | B2 * | 10/2019 | Papp | B44D 3/38 |
| 11,014,400 | B2 * | 5/2021 | Papp | G01B 3/1056 |
| 2002/0026723 | A1 | 3/2002 | Savalla | |
| 2009/0277027 | A1 * | 11/2009 | Grisham | B44D 3/38 24/588.1 |

* cited by examiner

*Primary Examiner* — Yaritza Guadalupe-McCall
(74) *Attorney, Agent, or Firm* — M. Susan Spiering; Ochoa & Associates, P.C.

(57) ABSTRACT

A simple, economical, chalk line hook device is disclosed for marking straight lines, or lines at an angle, comprising a single unit having a front and back side, a top and bottom side wherein the top side has a gripping region which includes at least one, preferably two, gripping fangs for helping to secure the hook device to a straight edge or a corner of a surface to be marked. The hook device can be used by a single individual for marking surfaces of interest and the string can be pulled in multiple angles to provide clearly visible and precision lines for further use by contractors. The hook device is uniquely designed to contain a non-pointed notched region within the top gripping portion of the device, so that the chalk line is wrapped over the front side of the hook device, over the notch, and pulled downward against the back side of the hook device toward the lower hole of the hook device. It has been found that this inventive device can mark straight lines, or lines at an angle, from 3' to over 30' in length, or longer, by a single individual, and can be done with simplicity and precision.

11 Claims, 8 Drawing Sheets

SNAPPING CHALK LINE ANGLES WITH PRECISION

FIELD OF THE INVENTION

This invention relates generally to construction tools and accessories and in particular to a snapping chalk line device capable of securing to straight edges and corners.

BACKGROUND

Chalk lines for marking surfaces on construction projects have been used in the construction industry for over 30 years. Chalk lines in particular have been used for marking straight lines on surfaces, in particle, plywood used on roofs before or after placement, or plywood or sheetrock used in general construction (e.g., walls, floors, window openings, foundations, etc.). Chalk lines and their corresponding chalk box or hooks (to attach the lines or strings) are a staple tool for marking surfaces, in particular for marking straight lines. The importance of a straight line in marking surfaces during construction projects is critical for the precision of the overall job. While marking tools for construction projects include pencils, crayons, and, markers, the most commonly used is the chalk line with a hook (or tied to a screw). Pencils, crayons, and markers have limitations when needing to mark long (generally longer than 3-5') lines, and therefore, workers often turn to chalk lines on hooks (or nails) for marking.

The surfaces of construction materials to be marked may be a variety of items, for examples, plywood, sheetrock, cement, concrete brick, shingles, or any other construction material. Unfortunately, a problem still in existence is the ability to secure the end of the chalk line, or the hook device portion to the given edge or location of interest on the surface. It is generally a two person task where one person holds the chalk line hook device, and the other person holds the end of the chalk (or snapping) line to the end of the desired location, and then snaps the chalk line taut or in place, creating a visible line. For marking long lines, this two-man operation makes the process labor intensive, costing the contractor time and money.

Another problem encountered with use of current chalk line devices, is often the line drawn is not perpendicular to the edge of the desired surface, or the line is not precise when snapped, creating an offset which leads to errors in the construction job; often these errors are compounded by imprecise chalk lines (especially on roofs when shingles are being placed). An imprecise line will often require a process of undoing the line (erasing somehow) and remarking. And if the new line is not sufficiently clear, it is likely that the contractor will cut or work based on the wrong line, having to start the process over, and/or possibly use new materials. Again, costing time and money or resulting in unsightly or unacceptable work.

It is clear that the hook or holder of the chalk string must be easy to use and capable of multiple functions, such as securing the line to make a straight or angled line, and upon snapping of the line, forming a precise line for working. Many hooks or string holding devices do not allow for angled lines easily or allow for the job to be marked by a single individual. Nor do current hooks allow for easy marking of multiple sheets of plywood to form, for example, a 20 or 30 foot line in one snapping by a single individual.

BACKGROUND ART

The prior art is replete with examples of chalk line devices intended to create a line or create a tool allow the hook portion to grip to an edge of the desired surface to be marked. Below is a representative list:

US 2002/0026723 is directed towards a chalk line adapted to clip to the edge of a board, regardless of stiffness of the board;

U.S. Pat. No. 5,937,532 is directed towards a releasable hook having a retractable clip to attach to the edge of a surface;

U.S. Pat. No. 6,082,014 is directed towards a chalk line end with the ability to mark lines at an angle from the board edge;

U.S. Pat. No. 6,931,743 B1 is directed towards a chalk line with selectively adjustable tip, wherein the tip has a string attachment portion;

U.S. Pat. No. 9,701,155 B2 is directed towards a chalk line having a pivot attachment for rotation of the chalk line;

U.S. Pat. No. 9,802,441 B2 is also directed towards a chalk line having a magnetized fastener for use on flat metal surfaces;

U.S. Pat. No. 10,071,594 B2 is directed towards a chalk line housing device containing a reel and liquid chalk within the housing, and the housing device further attached to a gripping unit.

It has been found that a need continues to exist for an improved chalk line device for the industry. A device which is economical, simple to use, preferably by one (1) individual, and provides a precise, taut line when marked. And further, can be used over several plywood sheets when marking, for example used when marking a line of over 20-30 plus feet.

SUMMARY OF THE INVENTION

Disclosed is an improved snapping chalk line hook device which eliminates the need for two individuals to create a chalk line on a surface to be marked, and provides a precise mark as needed for workers. The invention involves a unitary, or single unit, having a front and back side, the back side having a slightly curved central region; and the front side being predominately flat; a top side having a gripping region extending outward and away from the front at approximately 90 degrees; the gripping region having a top flat edge with a downward curved lip and at least one downward directed fang on the lower edge of the lip wherein the at least one fang extends slightly beyond the side of the hook device; the top flat edge has a non-pointed notch in the center position of the edge which is beveled towards the backside of the hook device; the hook device has an upper and lower hole, wherein the upper hole is on the top portion of the hook, and is larger than the lower hole. While the hook device is shown in a triangular shape, any other shape is acceptable provided there is a position to attach a gripping section. Suggested other shapes include rectangle, oval or circular having a top flat region, or, square. The front side of the hook device can optionally contain marking lines for creating lines on surfaces at specified, desired angles. This includes for example, angles such as 30, 45, 60, 75, 90 degrees.

An especially unique feature of the device is the ability to mark chalk lines from edges or corners without tacking nails or using outside products that are connected to the chalk line hook device. The inventive hook device can be used for straight or angled markings, and has been shown to work equally well for markings originating from corners of desired surfaces. Unlike other chalk lines and hooks, this inventive device can also make a complete chalk line on a surface starting from the edge of the desired surface.

DETAILED DESCRIPTION OF THE INVENTION

Figure 1:
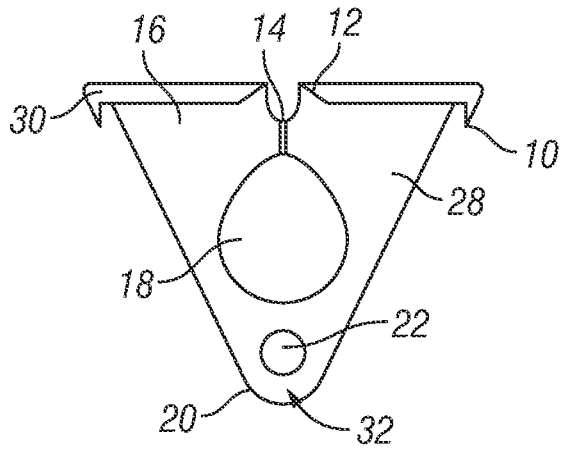
FIG. 1 illustrates back side of hook device showing fangs.

The present invention is described in connection with and by the attached Figures. The figures depicted are for exemplary purposes. The invention is described in detail below with reference to the drawings and examples. Such discussion is for purposes of illustration only. Modifications within the spirit and scope of the present invention, set forth in the appended claims, will be readily apparent to one of skill in the art. Terminology used throughout the specification and claims herein is given its ordinary meaning except as more specifically defined.

Disclosed herein is an improved chalk line hook device for marking straight lines on a surface of interest. The surfaces can be a varied, but examples include, but are not limited to, wood (e.g., plywood, engineered wood, laminated wood, and the like), cement (e.g., bricks, walls, and the like), concrete (e.g., driveways), shingles, or other types of construction materials.

The terms hook and hook device are used interchangeably and intended to mean the same inventive hook.

The terms chalk line and string are used interchangeably and are intended to mean the same string attached to the hook device for marking a surface.

The hook device comprises a single unit having a front and back side, the back side having a slightly curved central region; and the front side being predominately flat. The hook device has a top side or top portion having a gripping region extending outward and away from the front at approximately 90 degrees. The gripping region has a top flat edge with a downward curved lip and at least one downward directed fang on the outside edge of the hook and also placed with the lower edge of the lip. The fang extends slightly beyond of the sides of the hook device. It is preferable to have at least two fangs on the device, although more may be placed along the gripping region as desired, wherein at least one fang is placed on each outer edge of the gripping region. If the device is to be used on corners, the hook device is placed on a corner secured by the lower edges of the gripping region and the center notch (see FIGS. 7 and 8).

The top flat edge of the hook device further has a non-pointed notch in the center position, which is preferably beveled back towards the backside of the hook device. This beveling is based on desires of the user as it has been found that both straight edges and beveled edges work with the chalk line when moved through the notched region during use.

The hook device has an upper and lower hole placed about center of the hook, wherein the upper hole is larger than the lower hole. Preferably, the chalk line to mark the surfaces of interest is attached to the lower hole. It is understood by those of skill in the art that the chalk of the line will become used up with subsequent markings. As such, the chalk line itself is to be replaced periodically with new line for use in markings. This invention is not directed towards the line itself, but the hook to hold the line.

On the front side of the hook are optional markings for placement of a chalk line at differing angles. This allows the user to create lines on surfaces at specified, desired angles. This includes for example, angles at 30, 45, 60, 75, and 90 degrees.

Figure 11:
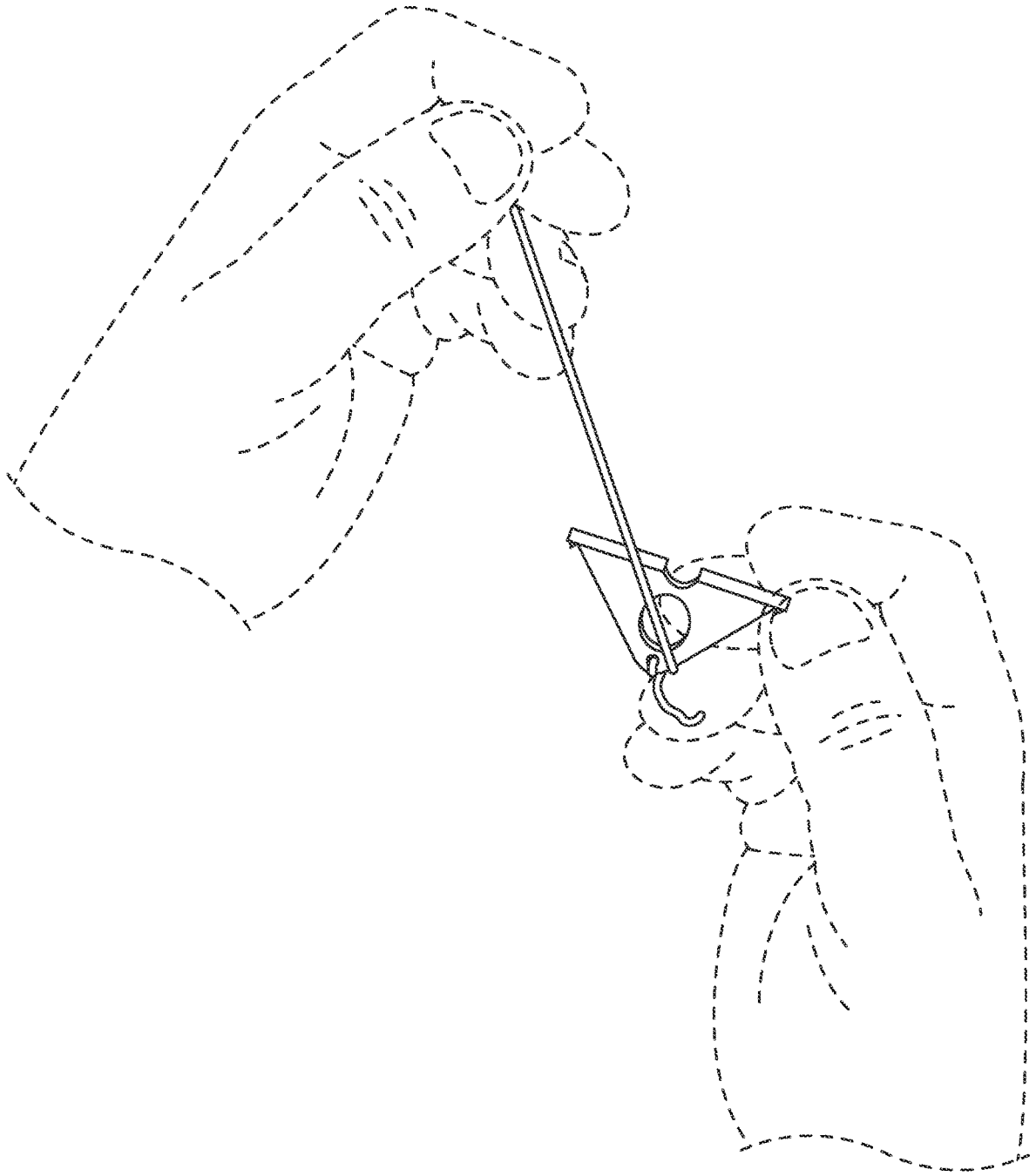
FIG. 11 illustrates step two with a ghost hand holding the hook device in preparation to use.
Figure 12:
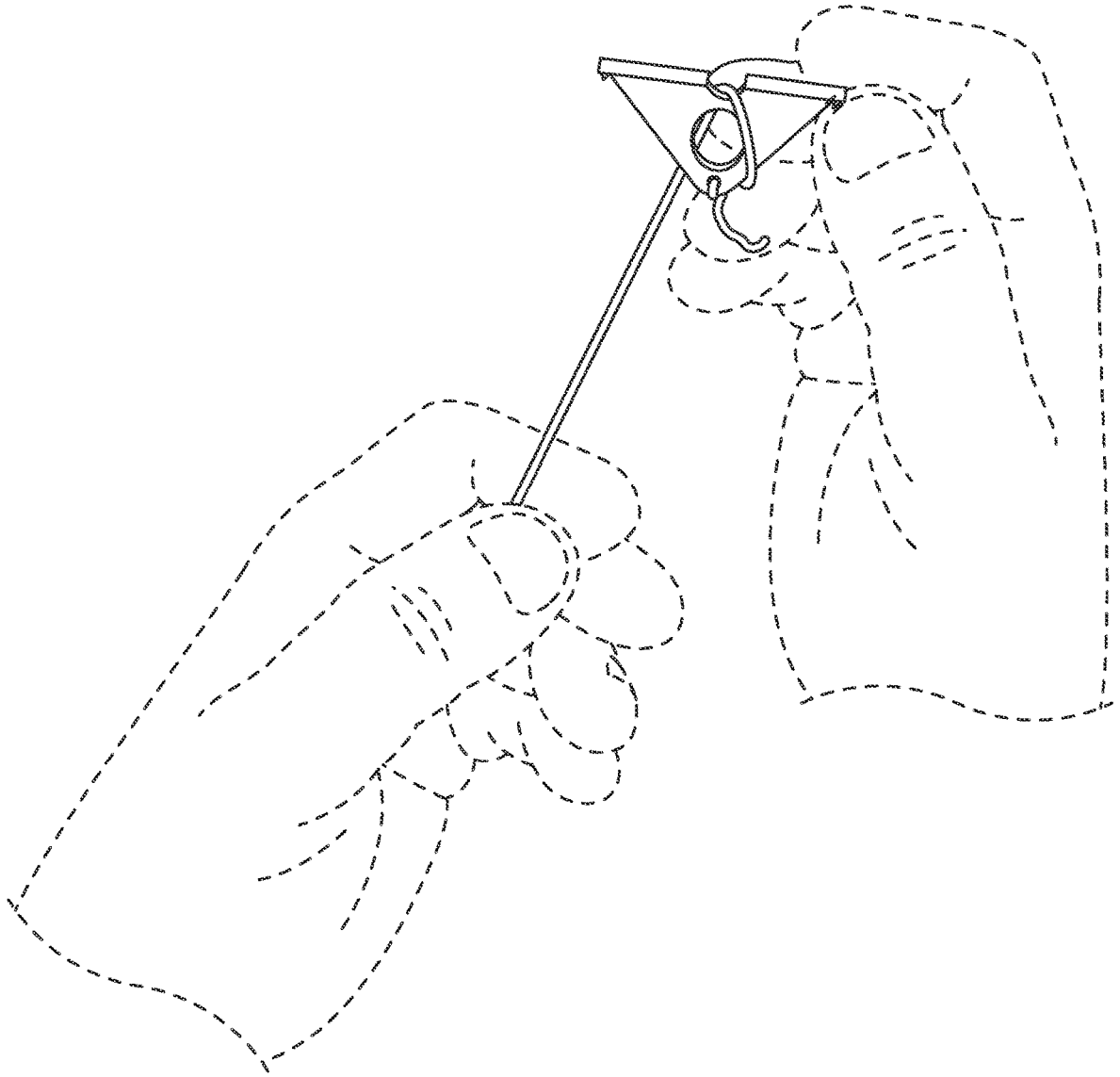
FIG. 12 illustrates step three with a ghost hand holding the hook device in preparation to use.

In use, the inventive hook device is first prepared for placement on the edge of a desired surface by holding the hook, having the chalk line secured to the lower (smaller) hole, (see FIG. 10), wrapping the chalk line over the front side of the hook device, (see FIG. 11), over the notch, and the line is then pulled downward against the back side of the hook device toward the lower hole of the hook device (see FIG. 12). The user will then place the hook at the desired location (straight edge or corner), hold the chalk line taut, and gently snap the chalk line creating the working line on the desired surface. While short lines, less than 3', can easily be marked, this inventive device has been found to mark straight lines, with precision, from 3' to over 30' in length, and can be done by a single individual without the need to place tack nails or screws to secure the hook on the desired surface.

Figure 2:
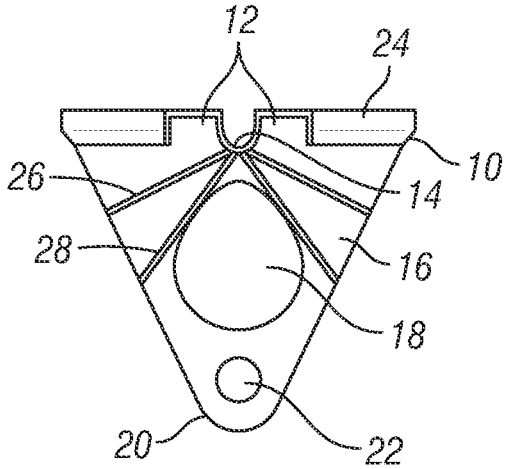
FIG. 2 illustrates front side of hook device.
Figure 3:
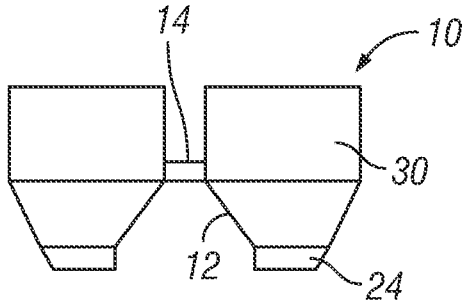
FIG. 3 illustrates top view of hook device.

FIGS. 1, 2, and 3 depict various views of the hook device, with FIG. 1 illustrating the back side of the device as a whole. The identified items are seen in FIGS. 1-4. This inventive hook for securing a chalk line is economical, ergonomic, and easy to be used by one individual. It's curved and flat edges allows for easy marking of the chalk line by allows the string to easily move on the back side of the hook before snapping. The design also allows for long marks to be precisely made, typically over 30 feet, by simply securing the hook to the desired surface edge. During use, the string is to be placed over the front side of the hook, over the notched center region 14, and pulled towards the back side of the hook. It is then placed on the desired surface. The string is now able to mark a given line starting essentially at the edge of the desired surface.

Accordingly, 10 illustrates the pointed fang used for gripping a desired surface edge, together with the bent area 24 at the end of the straight edge 30. Bent area 24 assists fang 10 to grip a surface edge. 12 is a beveled angle next to the center position notch 14. The beveling is at the inner edgings of the top 30, but also can be extended if desired to the edging of the notch 14. Shown is the notch and beveling in FIGS. 6 and 7. Optionally, the sides 12 can be beveled but not the notch 14, or both notch 14 and sides 12 are beveled. The notch 14 may be any cut out in any non-pointed indentation, shape, or notch. It has been found that a pointed notch leads to quick tearing of the chalk line. FIG. 2 shows a curved indentation 14, while FIG. 3 depicts a square or rectangular indentation 14.

FIGS. 2 and 3 depict the front and top views respectively, with FIG. 2 also showing optional markings for making angled lines on surfaces. FIG. 2 further identifies 10 fang, 12 inner edged beveling, 14 as a curved or semi-circular notch, 16 as the flat region of the hook device, 18 depicts the large hole, and 22 depicts the second smaller hole of the hook device. The smaller hole 22 is primarily used for securing the chalk line. Larger hole 18 can be used, if desired, to secure the hook to a screw or nail on the marking surface. Or for hanging the hook device for later use. Section 20 is the bottom edge of the hook device, shown here as a curved or rounded portion, while 32 represents the lower region of the hook device. This rounded edging is not mandatory for the use of the hook, and can be as desired by the user. It is shown curved for exemplary purposes. It has been found however, that a round lower portion allows the string to slide easily under the hook when marking chalk lines. FIG. 2 further identifies 26 line indentations useful for marking different angles with the chalk line, and item 28 which depicts the raised section of hook device (28 also seen from a different angle in FIG. 4). Curvature 28 can be up to about ¼ inch, preferably about an 1/16-⅛.

FIG. 3 shows an alternate view of the inner edging beveling 12, and bent area 24, and top flat region 30 of the hook device, as well as the center top indentation 14.

Figure 4:
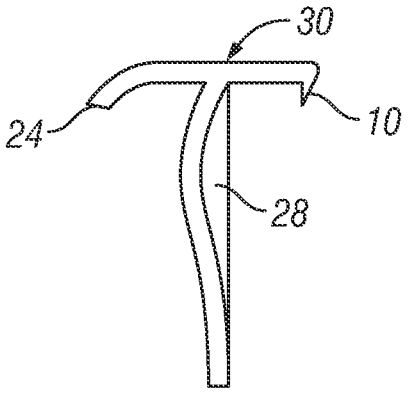
FIG. 4 illustrates side view showing outward curved region.

FIG. 4 illustrates a side view showing the outward curved region 28. The curvature makes the hook more ergonomic, but also allows for a continuous line to be snapped to the top center of the chalk line hook, and to a precise pencil mark point. Often, when snapping lines, a pencil mark will be placed on the marking surface at the beginning of the line and at the end. This curvature also allows for the string to move easily in any angled position. Also seen is the bent area 24, the fang 10, and the top straight edge 30.

Figure 5:
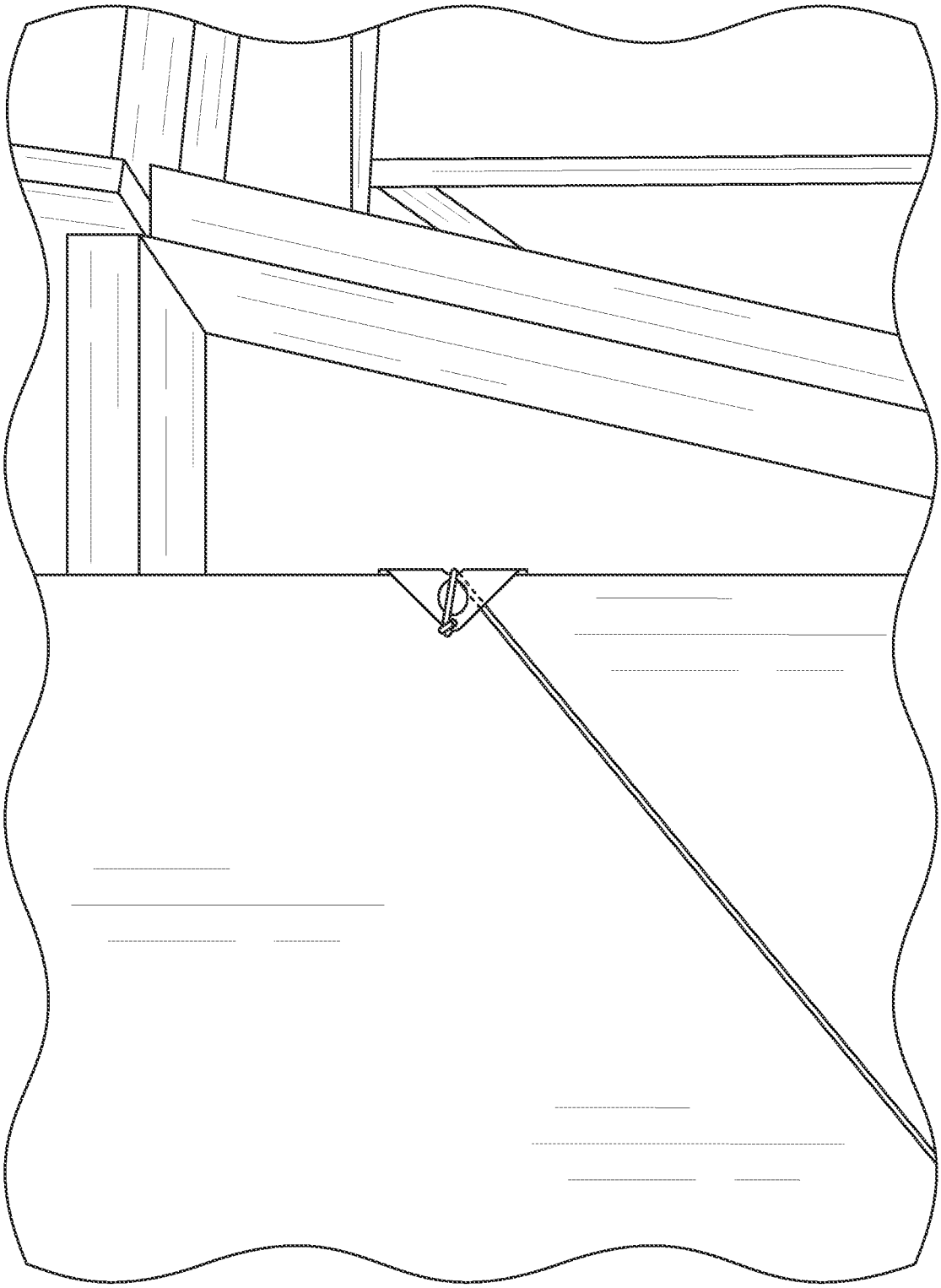
FIG. 5 top view of hook device shown on edge of plywood.

FIG. 5 illustrates the hook device on a straight edge, with the chalk string shown secured to lower hole 22 and over the notched region 14, and pulled towards the backside of the hook device at an angle. It can be seen that from this position, the chalk can mark the line from the edging of the surface. The chalk string is laying here between the desired marking surface and the hook itself. A user now just needs to gently snap the string to form the desired chalk line.

Figure 6:
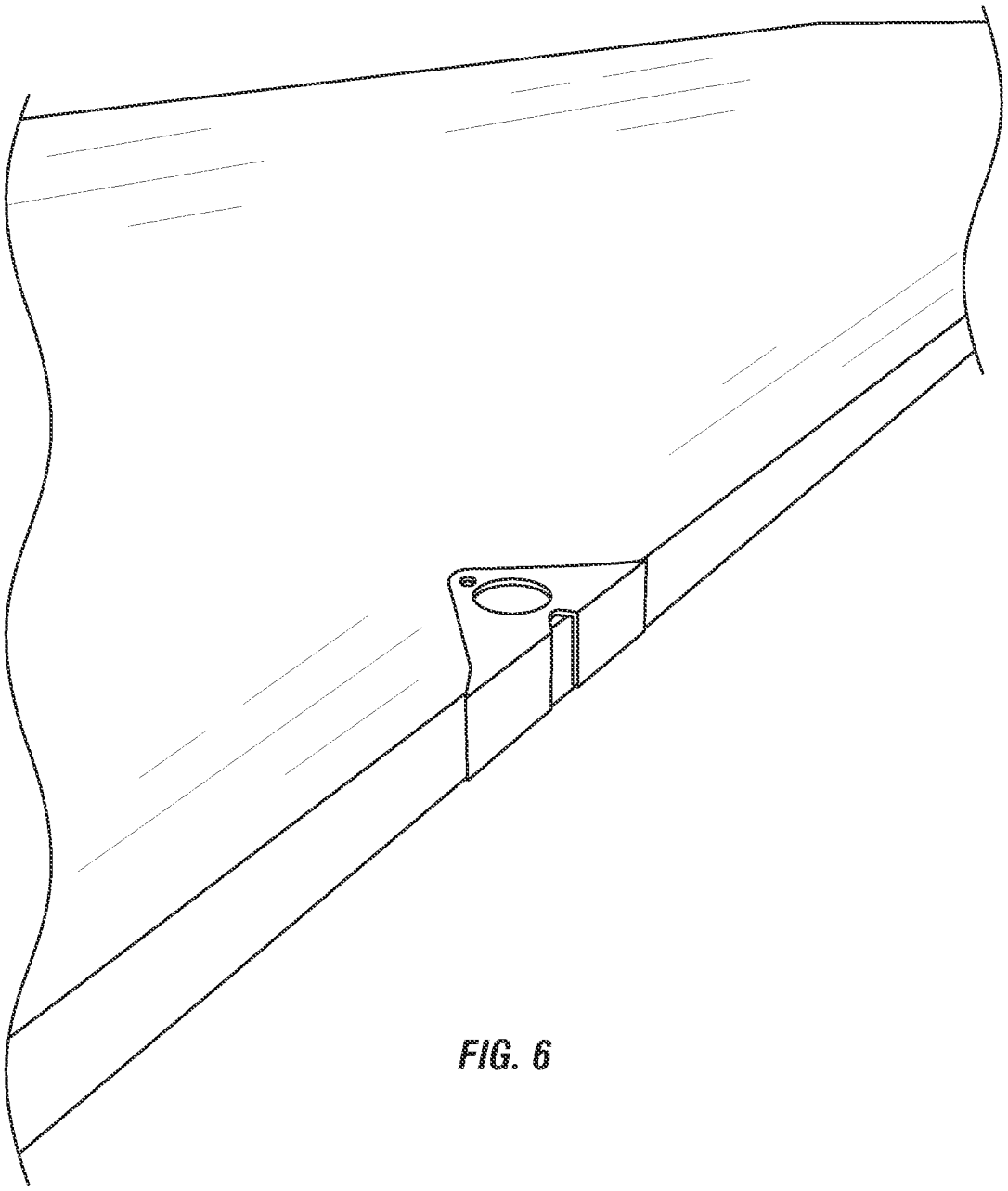
FIG. 6 side view of hook device shown on edge of plywood.

FIG. 6 illustrates the hook device shown on a straight edge of a plywood surface. Seen is the hook device secured with the top flat edge 30 laying directly next to the edge of the wood, as well as the curved notch 14, the large hole 18 and the small hole 22. Not seen here, is the underside of the surface wherein the gripping lip or bent area 24 is assisting the fangs 10 to grip the hook to the surface.

Figure 7:
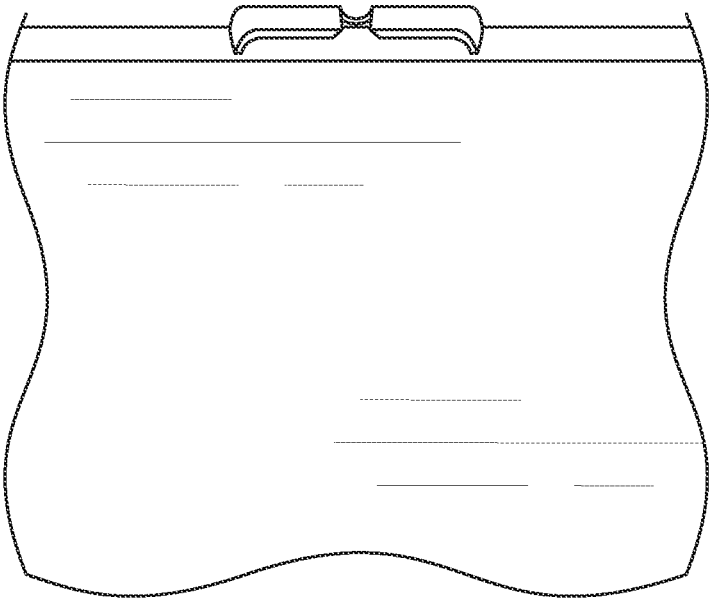
FIG. 7 underside view of hook device shown on edge of plywood.

The underside of the hook is shown in FIG. 7 wherein the hook device is seen on the straight edge of a surface. One can see the fangs gripping into the surface. While it is preferred the fangs 10 be set slightly outside the edges of the hook device, the fangs can also be placed at the same width as the top edging 30. It has been found that the fangs being placed slightly outside the outer edge of the hook device allows for a better grip on the edge of the desired surface, than if the fangs were placed at the same width as the edge 30.

Figure 8:
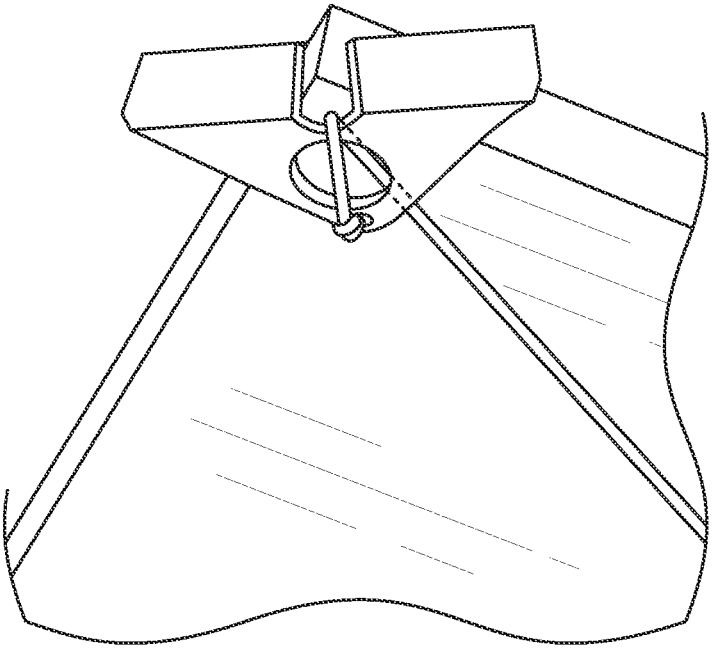
FIG. 8 top view of hook device shown with string and secured to a corner of plywood.

FIG. 8 illustrates a top view of the hook device shown with a chalk line and the hook device secured to a corner of a plywood surface. The hook is secured in place with the lip or bent area 24 and the notch. The chalk line can be seen placed over and under the hook for use in marking the surface with chalk.

Figure 9:
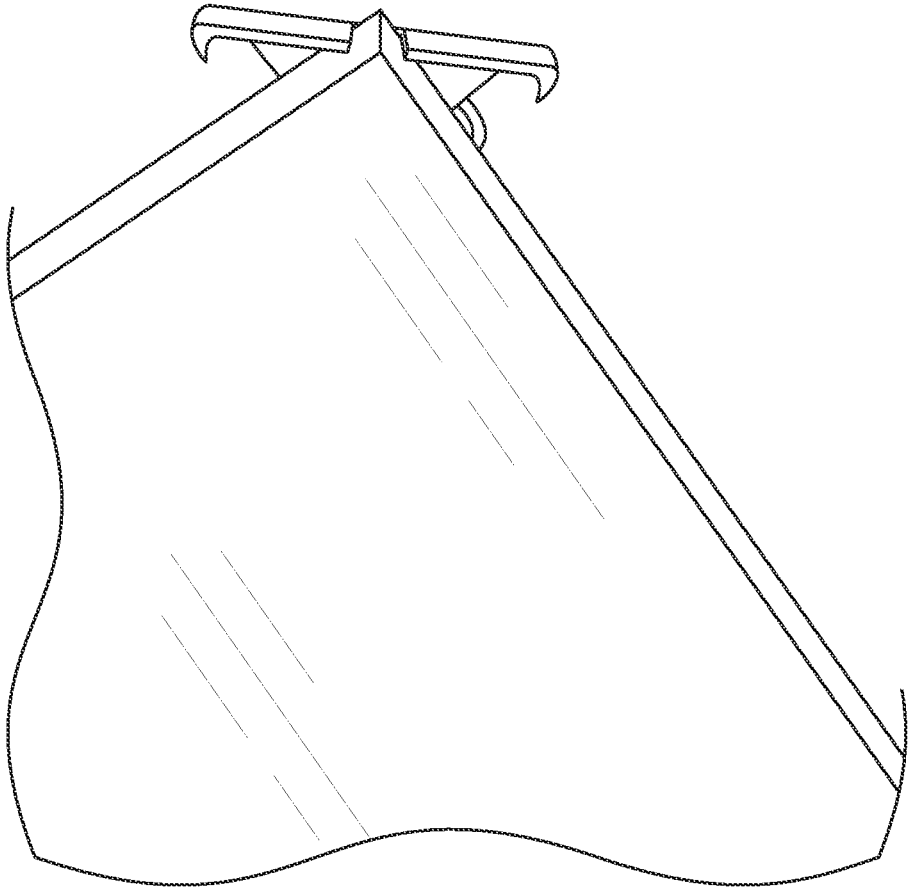
FIG. 9 underside view of hook device shown on a corner of plywood.

FIG. 9 shows the underside view of hook device secured to a corner of a plywood surface. For this use, the hook is secured via the beveled edges 12 and the notched region 14.

Figure 10:
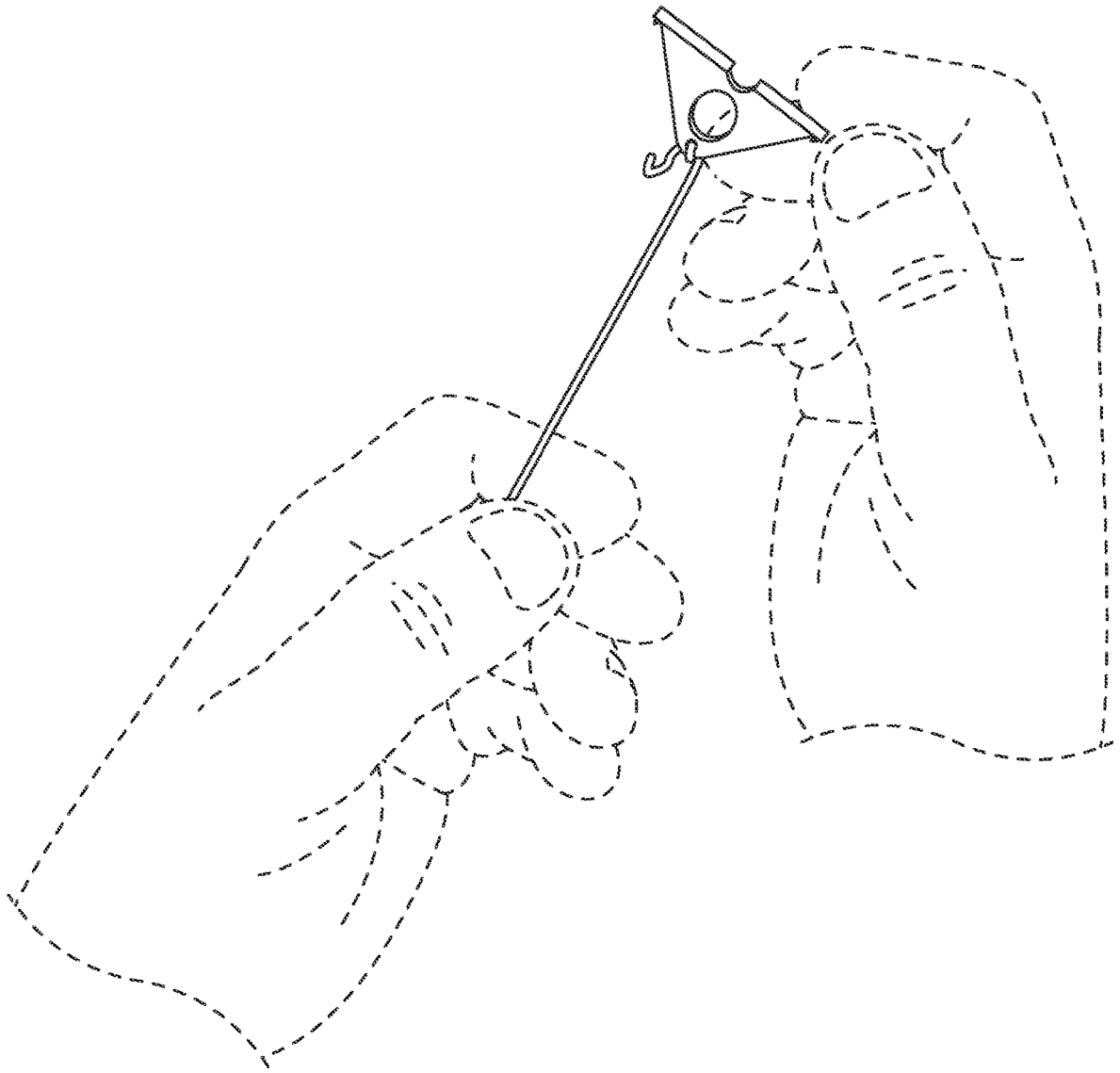
FIG. 10 illustrates step one with a ghost hand holding the hook device in preparation to use.

FIGS. 10-12 illustrate how to prepare the hook for use on a surface with FIG. 10 illustrating step one. Seen in FIG. 10 is a ghost hand holding the hook device in preparation to use between the users' thumb and forefingers with the chalk line being held with the opposite hand. FIG. 11 illustrates step two with one hand holding the hook and the other hand pulling the chalk line (or chalk string) over the hook towards the notch 14. FIG. 12 illustrates the third step with the chalk line pulled over the notch 14 towards the back of the hook, and the string held taut. The user is now ready to place the hook device on the desired edge for marking the desired surface.

Unlike conventional, prior art devices, the inventive chalk line hook device is able to mark angled lines without the aid of pivoting mechanisms. One device is able to precisely mark both straight and angled lines with one person handling the device. When used as described with the chalk line pulled above the notch and behind the device, the device is further able to mark an entire line from the edge of the desired surface to the end point precisely. The curved backing of the inventive device allows for the chalk line to easily move for positioning for angled lines. A gripping means is provided which includes a flat edge to sit against the edge as well as a lip region and at least one, preferably two fangs, to remain secured against the desired edge.

EXAMPLES

Example 1

The hook device was used on a roof for marking plywood to subsequently place shingles. It was found that consistently, the hook worked to grip the edge and the marking was conducted by one worker. The chalk line produced was precise and visible.

Example 2

The hook device was used on roof for marking plywood to cut multiple plywood angles on roof. A line was snapped on a ½" plywood on top of a Hip Roof and one person was able to snap multiple plywoods to mark a 30 ft line, from the top of the roof all the way to the bottom of a hip roof, point of fascia, and found no need for a tact nail or extra man to help.

While the invention has been described in detail, modifications within the spirit and scope of the invention will be readily apparent to those of skill in the art. In view of the foregoing discussion, relevant knowledge in the art and references discussed above in connection with the Background of the Invention, the disclosures of which are all incorporated herein by reference, further description is deemed unnecessary. In addition, it should be understood that aspects of the invention and portions of various embodiments may be combined or interchanged either in whole or in part. Furthermore, those of ordinary skill in the art will appreciate that the foregoing description is by way of example only and is not intended to limit the invention.

What is claimed is:

1. A chalk line hook device for marking straight lines on a flat surface comprising:

a single unit having a front and back side, the back side having a slightly curved central region; and the front side being predominately flat;

a top side having a gripping region extending outward and away from the front at approximately 90 degrees;

the gripping region having a top flat edge with a downward curved lip and at least one downward directed fang on the lower edge of the lip wherein the at least one fang extends beyond the sides of the hook device;

the top flat edge further having a non-pointed notch in the center position;

an upper and lower hole on the chalk line hook device, wherein the upper hole is larger than the lower hole wherein a chalk line is attached to the lower hole and the chalk line is wrapped over the front side of the hook device, over the notch, and the line is pulled downward against the back side of the hook device toward the lower hole of the hook device.

2. The chalk line hook device of claim 1 wherein the edges of the center-position notch and the inner edges of the gripping region are beveled towards the backside of the hook device.

3. The chalk line hook device of claim 1 wherein the front side contains markings for placement of a chalk line at differing angles.

4. The chalk line hook device of claim 1 wherein the hook device contains at least two fangs, wherein further at least one fang is placed on each outer edge of the gripping region.

5. The chalk line hook device of claim 1 attached to a straight edge of a surface to be marked.

6. The chalk line of claim 5 wherein the surface is a plywood board.

7. The chalk line hook device of claim 6 wherein once secured to the edge, a single individual snaps the chalk line creating a marked line.

8. The chalk line hook device of claim 1 attached to a corner of a surface to be marked.

9. The chalk line hook device of claim 8 wherein the surface is a plywood board.

10. The chalk line hook device of claim 9 wherein once secured to the corner, a single individual snaps the chalk line creating a marked line.

11. A method to use a chalk line hook device for marking straight lines on a flat surface comprising:

a single unit having a front and back side, the back side having a slightly curved central region; and the front side being predominately flat;

a top side having a gripping region extending outward and away from the front at approximately 90 degrees;

the gripping region having a top flat edge with a downward curved lip and at least one downward directed fang on the lower edge of the lip wherein the at least one fang extends beyond the sides of the hook device;

the top flat edge further having a non-pointed notch in the center position;

an upper and lower hole on the chalk line hook device, wherein the upper hole is larger than the lower hole, and a chalk line is attached to the lower hole wherein the line is pulled over the front and over the center notched region, towards the back side of the hook, the hook is secured to a desired marking surface and an individual snaps the chalk line taut to create a visible line on the surface.

* * * * *